US006695276B2

(12) United States Patent
Skorka

(10) Patent No.: US 6,695,276 B2
(45) Date of Patent: Feb. 24, 2004

(54) WALL HANGER ASSEMBLY

(76) Inventor: Richard Skorka, 269 S. Beverly Dr., Suite 282, Beverly Hills, CA (US) 90212

( * ) Notice: Subject to any disclaimer, the term of this patent is extended or adjusted under 35 U.S.C. 154(b) by 0 days.

(21) Appl. No.: 10/187,169

(22) Filed: Jun. 28, 2002

(65) Prior Publication Data

US 2003/0127578 A1 Jul. 10, 2003

Related U.S. Application Data

(60) Provisional application No. 60/348,323, filed on Jan. 10, 2002.

(51) Int. Cl.[7] ..... A47G 1/16

(52) U.S. Cl. ..... 248/497; 248/217.1; 248/317; 248/475.1; 248/489

(58) Field of Search ..... 248/489, 497, 248/216.1, 216.4, 475.1, 217.1, 221.11, 220.31, 371

(56) References Cited

U.S. PATENT DOCUMENTS 2,312,985 A * 3/1943 Bales ..... 248/220.43
2,987,286 A * 6/1961 Alling ..... 248/220.31
3,008,249 A * 11/1961 Masters ..... 434/421
3,188,028 A * 6/1965 Waller ..... 248/489
3,312,442 A * 4/1967 Moeller ..... 248/216.1
3,337,172 A * 8/1967 Jackson ..... 248/222.51
3,547,389 A * 12/1970 Mitchell ..... 248/216.1
3,879,006 A * 4/1975 Staudte, Jr. ..... 248/220.43
3,979,006 A * 9/1976 Jurasek ..... 220/485
4,105,179 A * 8/1978 Elliott ..... 248/220.43
4,362,249 A * 12/1982 Thalenfeld ..... 211/59.1
4,394,909 A * 7/1983 Valiulis et al. ..... 211/59.1
4,485,995 A * 12/1984 Hogg ..... 248/218.1
4,509,713 A * 4/1985 Hogg ..... 448/546
4,708,311 A * 11/1987 Clausen et al. ..... 248/220.31
4,714,221 A * 12/1987 Cawrey ..... 248/220.42
4,858,871 A * 8/1989 Romano ..... 248/339
4,941,632 A * 7/1990 Couls et al. ..... 248/220.43
5,018,697 A * 5/1991 Treanor et al. ..... 248/547
5,028,026 A * 7/1991 Philipps ..... 248/206.2
5,028,030 A * 7/1991 Lewis ..... 248/493
5,899,430 A * 5/1999 Malakates et al. ..... 248/489
5,984,118 A * 11/1999 Morrow ..... 211/59.1
5,992,813 A * 11/1999 Keers ..... 248/489
6,042,078 A * 3/2000 Donovan ..... 248/547
6,338,460 B1 * 1/2002 Rumpel ..... 248/229.16
6,454,230 B1 * 9/2002 Accuardi ..... 248/220.31

* cited by examiner

*Primary Examiner*—Ramon O. Ramirez
*Assistant Examiner*—Amy J. Sterling
(74) *Attorney, Agent, or Firm*—James E. Brunton

(57) ABSTRACT

A hanger device 10 in an assembly of a clip 12 and a support member 13 for installation upon a wallboard 20. Clip 12 is formed as one piece, having an upturned arm (18), a downwardly turned leg (15), and a horizontally oriented extension member (16) connecting the two together. A hook (14) is mounted on leg (15) and a pointed end (22) is mounted on the terminal end of arm (18). An opening (21) is formed in support member (13) so as to mate geometrically to the rectangular cross section of extension member (16) to prevent turning of clip (12) after installation of device (10) in wallboard (20). A plurality of spaced-apart apertures (26) are provided in support member (13) for insertion of fasteners (25) to attach support member (13) to wallboard (20) and thus device (10). Device (10) carries much more weight in an article (44) than that of the present state-of-the art hangers.

5 Claims, 2 Drawing Sheets

WALL HANGER ASSEMBLY

This is a Non-Provisional Application based on Provisional Application No. 60/348,323 filed Jan. 10, 2002.

BACKGROUND OF THE INVENTION

1. Field of the Invention

This invention is directed to a hanger device and in particular to a combination of a clip and its support member by which erosion or deterioration of a wall and its makings to which the device is mounted is eliminated.

2. Discussion of the Prior Art

In the past, prior practice in mounting a picture frame or other article upon a wall with a hook-like member never seriously considered any shearing or downward force that caused an erosion or deterioration of the wallboard out of which the wall was made. The weight imposed by an article, such as a picture, its frame, and wire hanging on an ordinary or customary hook, would cut into or break down the wall and its thickness of the wall board behind it at the same time that a heavy object would be applied or soon thereafter. There has become a need for a heavy object hanging device that would not breakdown, erode away or deteriorate the wall and its wallboard makings. Prior art teachings on hangers are disclosed in U.S. Pat. Nos. D33,550; D193,982; D199,841; D252,975; D301,975; D322,388; 541,114; 2,266,294; 3,091,424; 3,193,225; 3,193,234; 3,219,302; 3,268,195; 3,376,911; 3,392,949; 3,536,287; 3,537,671; 3,966,157; 4,270,719; 4,422,608; 4,482,121; 4,505,447; 4,613,108; 5,160,126; and 6,036,149.

In the installation of prior-art hangers to wallboard, a shearing stress or force occurring in a downward direction would cause an erosion in or deterioration of the wallboard's strength. These disadvantages are eliminated by the present invention thus eradicating the long-time results of hangers falling out of the wallboard because of the weight imposed by an article, such as a picture, its frame, and the wire hanging on an ordinary hook, as the customary hanger itself would cut into or shear downwardly through the wallboard at the same time the article would be applied or soon thereafter. The body formation in this invention for the geometrically configured, non-circular opening in the support member is of the same geometrical configuration as the cross-sectional configuration of the device's extension member so that the device is strongly supported in its originally mounted location on the wallboard. The invention provides the advantage of the hanger device supporting the weight of articles of a weight substantially greater than the weight of articles carried by state-of-the art hangers.

An object of this invention is to provide a novel hanger device.

Another object of this invention is to provide the elimination of an erosion and/or deterioration of a wall and its wallboard that occurs with state-of-the art hangers.

Yet another object of this invention is to remove or lessen a shearing impulse on drywall utilized in the formation of a wall by reason of the horizontally oriented extension member.

A further object of this invention is to provide stability in the support member by reason of its fastening to the wall or wallboard.

A still further object of this invention is to insure that the wall is in substantially the same structural condition after removal of the subject matter of this invention as it was prior to installation of the subject matter of this invention.

Yet another object of this invention is to provide a strong hanger device that safely carries an article of substantial weight.

Still another object of this invention is to preclude the hanger from accidentally falling out of the wallboard along with the article carried by the hanger assembly.

These and other objects and advantages of the invention will become more apparent upon a full and complete reading of the following description of the subject matter of the invention, the appended claims thereto, and the accompanying drawings comprising two (2) sheets of seven (7) figures.

DESCRIPTION OF THE INVENTION

Figure 1:
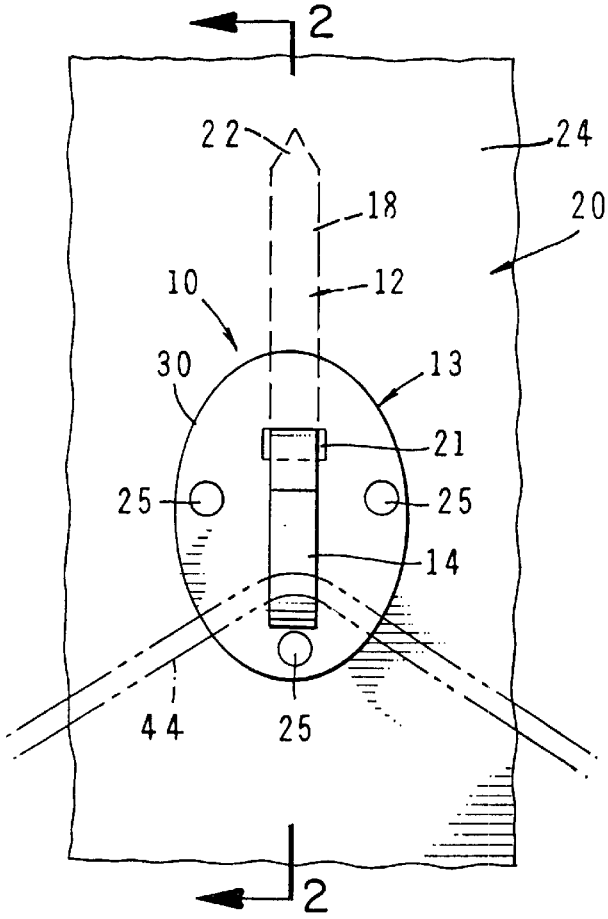
FIG. 1 is a front view of the hanger device of the present invention as it appears when mounted to a wallboard.
Figure 2:
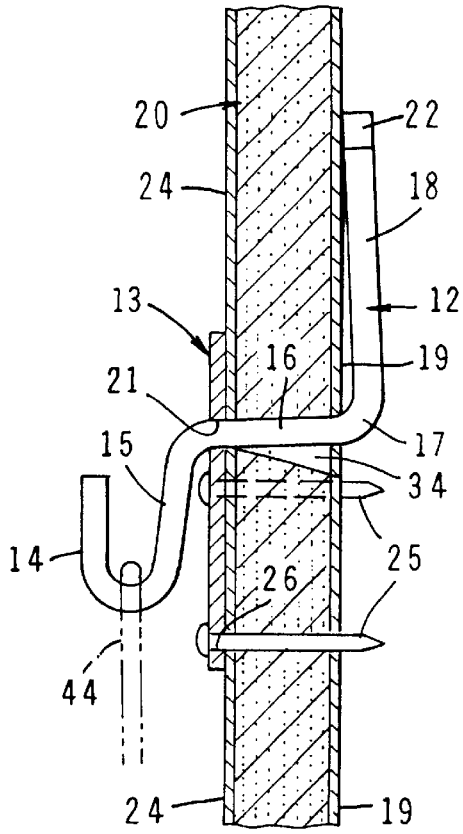
FIG. 2 is a view taken along lines 2—2 of FIG. 1.
Figure 3:
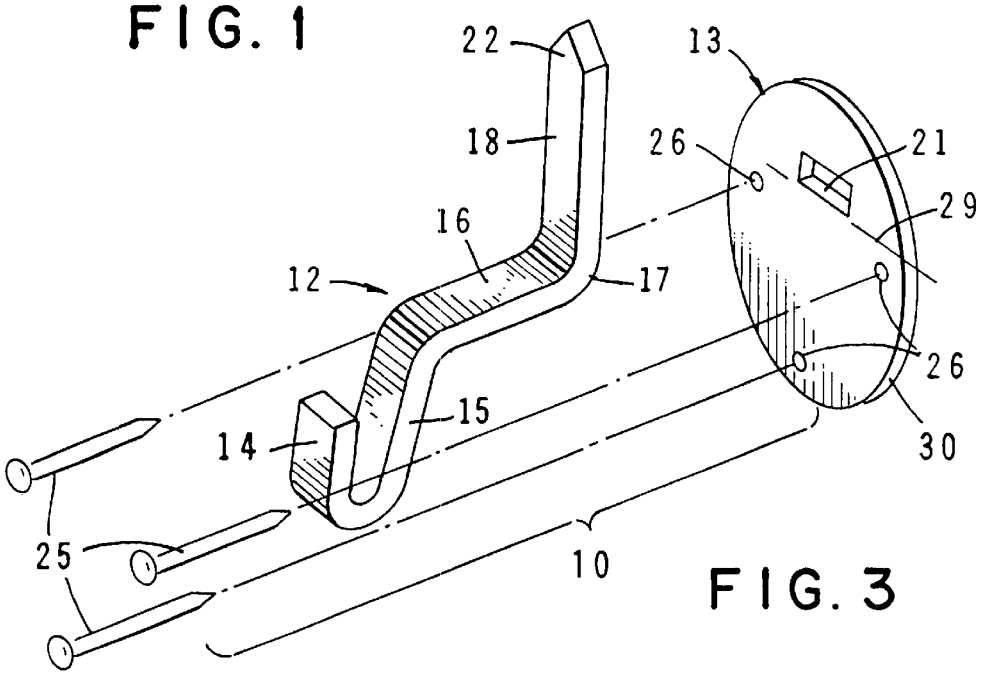
FIG. 3 is an exploded, generally perspective view of the hanger device in a disassembled condition and prior to its interconnection with a conventional wallboard.
Figure 4:
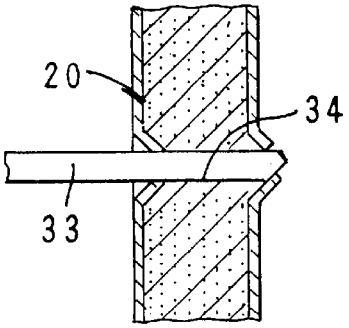
FIG. 4 is a cross-sectional view of a portion of a wallboard being penetrated by a puncturing tool preparatory to the interconnection therewith of the hanger device of the present invention.

Referring to the drawings wherein reference characters therein refer to like numeral hereinafter, FIGS. 1, 2, and 3 illustrate the hanger device 10 of this invention. Device 10 is of a combined pair of elements 12, 13, element 12 being of an integral body configuration fabricated into the form of a member or clip that includes a hook 14 mounted on a downwardly turned leg 15 extending from a horizontally oriented extension member 16 which at the other end of extension member 16 an elbow 17 integrally connects extension member 16 to an upwardly turned arm 18 formed, adapted to abut and engage the back or interior side 19 of a wallboard 20 to which hanger device 10 is to be mounted. As shown in FIGS. 2 and 3, extension member 16 is of a first length while arm 18 is of a second length substantially greater than the first length of member 16. Additionally, it can clearly be seen in FIG. 3 that extension member 16 has a width substantially greater than its thickness. Element 13 is a support member, vertically oriented relative to extension member 16, through which the horizontally oriented extension member 16 projects by means of a geometrically configured opening 21 formed through and in the body formation of support member 13. As illustrated in FIG. 2, hanger element 12 has an overall length substantially greater than the length of support plate 13.

Figure 5:
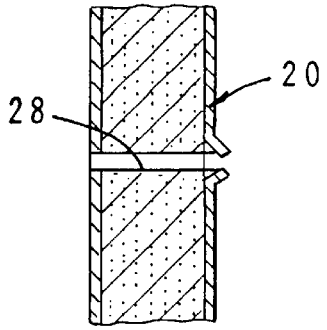
FIG. 5 is a cross-sectional view of the portion of the wallboard in a succeeding stage of preparation of application to that illustrated in FIG. 4.
Figure 6:
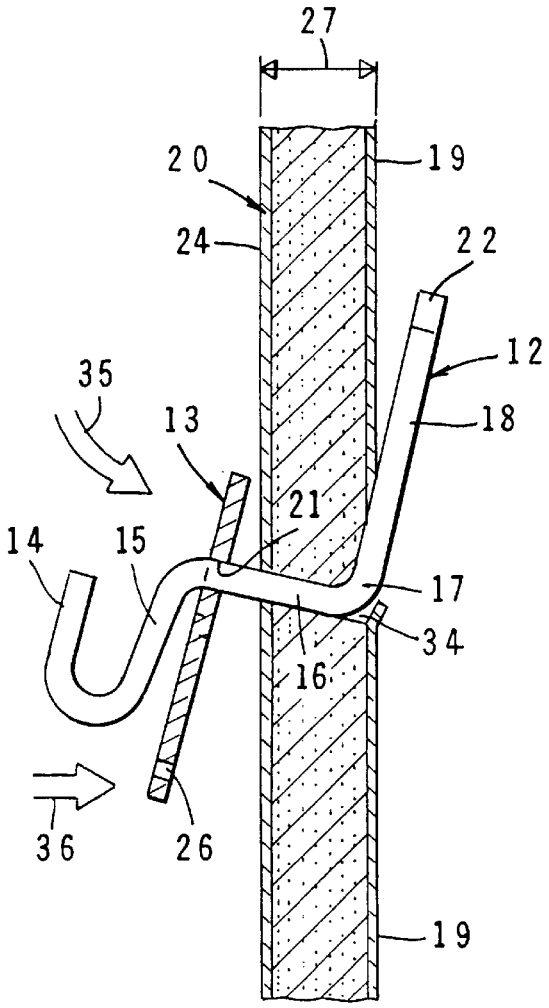
FIG. 6 is a cross-sectional view of the hanger device of this invention being installed to the wallboard.

The entire length of clip 12 is preferably fabricated into an integral body of the same width and of a rectangular cross-sectional area, with the exception of a pointed end 22 (FIGS. 2, 3, 6, 7) formed at the terminal end of the upwardly turned arm 18. Pointed end 22 facilitates the insertion of element 12 in the installation of device 10 into wallboard 20. The opening 21 is configured to closely mate with the particular geometrical cross section of extension member 16, here being shown as being rectangular in cross section, so that in the combined and assembled modes, the cooperating elements cannot turn about in the opening 21 and about the inner and outer side (walls) 19, 24 respectively, of wallboard 20. A multiple number of fasteners, such as brads 25, are provided for fastening element 13 to wallboard 20 and securing device 10 to wallboard 20. Brads 25 are applied through their corresponding apertures 26, spaced from one another, in support member 13 to attach such member to a thickness 27, (FIG. 7) of the wallboard 20 via punched holes 28 (FIG. 5), through thickness 27. In the illustrated embodiment, three (3) spaced apertures 26 are formed in a triangular context in support member 13. It has been found from engineering testing that the illustrated upper two spaced apertures 26 are best formed along a level line 29 (FIG. 3), in close proximity with the bottom level of opening 21 and with all of the apertures 26 each being located from an edge 30 of support member 13 a distance approximating or equated to the width or diameter of the fastener or brad 25 itself, as is shown in the illustrated embodiment, while the third or lower hole 26 is positioned proximate to the lowest point of edge 30 of support member 13. The integrally formed extension member 16 projects through its mated geometrically configured opening 21 in support member 13, the extension member 16 being of sufficient length to pass through and extend to beyond both the frontal or outer side 24 and interior side 19 of the width of thickness 27 of wall board 20.

In applying device 10 to an actual operation of installation to a wallboard 20, preparatory steps are best considered to be undertaken to obtain a maximum worth of installation. Viewing FIGS. 4–7, a manual insertion and withdrawal of an instrument 33 to form a punched hole 34 throughout wallboard 20, is utilized. A Phillips screwdriver, an awl or drill bit comprise examples of such a useful instrument 33. Punched hole 34 is of a size suitable for the subsequent insertion of the mated geometrical cross-sectional configuration of extension member 16 and its pointed end 22, the size being large enough so that elbow 17 passes through the instrument-formed hole without unduly weakening the material of wallboard 20 which remains after withdrawal of instrument 33. With support member 13 first being assembled and mounted to extension member 16 of clip 12 via its opening 21, the pointed end 22 of arm 18 enters hole 34 and is advanced (arrow 35 in FIG. 6) through thickness 27 as hook 14 is pressed (arrow 36) towards and pushed downwardly of the outer side 24 of wallboard 20. Arm 18 in the meantime is completely through wallboard 20 and is being moved in an upward direction and toward the interior side 19 of the wallboard as leg 15 approaches outer side 24. At the same time, hook 14 and support member 13 are pushed or pressed against outer side 24. Arm 18 consequently abuts and engages the interior side 19 of wall board 20, seating against it. Brads 25 are supplied through their corresponding apertures 26 in support member 13 in its assembly to wallboard 20. As illustrated in FIGS. 2 and 3 of the drawings, downwardly turned leg 15 extends from extension member 16 at an angle greater than 90 degrees. Similarly, as shown in FIG. 2, upwardly turned arm 18 extends from extension member 16 at an angle less than 90 degrees.

Figure 7:
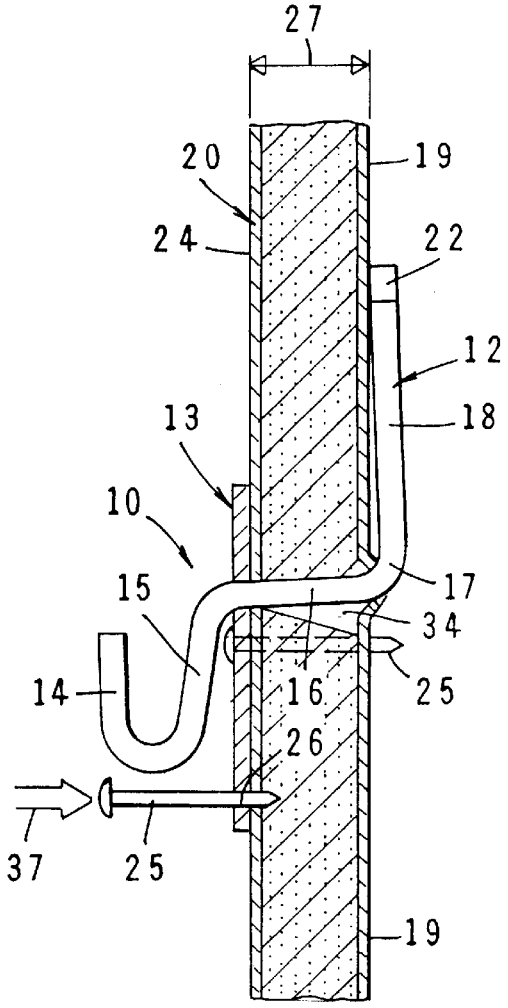
FIG. 7 is a cross-sectional view illustrating the succeeding step of installation of the hanger device to that illustrated in FIG. 6.

FIGS. 3 and 7 illustrate (arrow 37) the introduction of brads 25 into their respective apertures 26 in support member 13 as the later seats against outer side 24 of wallboard 20, thus securely fastening device 10 to wallboard 20. After completion of installation of device 10, a weighted article 44 is hooked to hook 14.

The invention provides the advantage in device 10 to support the weight of an article 44 having a weight much greater than the weight that can be safely supported by present state-of-the art hanging devices.

Whereas, when present state of the art heavy object wallboard hangers are installed with the maximum prescribed weight (100 lbs.) imposed on them, the universal tendency is for the hanger to shear downward through the wallboard thickness (27) thus rendering the hanger ineffective. Conversely, when device 10 is installed and the maximum prescribed weight (200 lbs.) is imposed on it, the tendency to shear the wallboard in a downward direction is averted due to the combination of elements 12, 13, and 25.

Heretofore customary and known hangers have fallen out of a wallboard 20 because of the weight imposed by an article, such as a picture, its frame, and wire hanging. In this invention, the body formation (FIGS. 1 and 3) in support member 13 for configured opening 21 mates with the same geometrical cross-sectional configuration of extension member 16, here the example being of rectangular cross section, to support hanger 10 in its originally defined position on wallboard 20, without clip 12 turning about wallboard 20 or element 13.

Various changes and modification may be made without varying or departing from within the spirit and scope of the invention. Elements 12, 13 are preferably fabricated from a suitable metal, their fabrication made by known techniques and equipment. Other materials, such as plastic and wood, may also be used and be found to be as strong in device 10 so as to carry articles of weights far exceeding an article's weight carried by customary and other state-of-the art handing devices. The arm (18) and leg (15) may be of different configured designs than their illustrations presented in the drawings.

Industrial Applicability

The invention is applicable to every use, in industrial, commercial, and any other industry, in which an article is to be hung to a wallboard and its wall.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following documents.

I claim:

1. A hanging device for hanging an article to a wall by puncturing a wallboard of a first thickness forming the wall comprising the combination of:

(a) a hanger having a hook formed on a leg of the hanger, an arm extending in an upturned direction from the direction of the leg and a horizontally oriented extension member integrally formed with and disposed between said leg and arm, said extension member being of a first length and said arm being of a second length greater than said first length, said arm extending upwardly from said extension member at an angle less than 90 degrees and said leg of said hanger extending from said extension member at an angle greater than 90 degrees; and (b) a support member to which said hanger is attached, said support member having a curved lower margin, a length and an opening therethrough, said opening having a bottom, said opening being of substantially the same cross-sectional geometry as that of said hanger for mating, such mating preventing said hanger from turning about said support member, said extension member being mounted to said support member through such opening in their combination to each other.

2. The hanging device as defined in claim 1 in which said extension member has a width and a thickness, said width being greater than said thickness.

3. The hanging device as defined in claim 2 in which said extension member is of a length greater than the first thickness of the wallboard.

4. The hanging device as defined in claim 3 in which said hanger is of an overall length greater than said length of said support member.

5. A hanging device for hanging an article to a wall by puncturing a wallboard of a first thickness forming the wall comprising the combination of:

(a) a hanger having a length and hook formed on a leg of the hanger, an arm extending in an upturned direction from the direction of the leg and a horizontally oriented extension member integrally formed with and disposed between said leg and arm, said extension member having a thickness and a width greater than said thickness and being of a first length and said arm being of a second length greater than said first length, said arm extending upwardly from said extension member at an angle less than 90 degrees and said leg extending from said extension member at an angle greater than 90 degrees; and (b) a support member to which said hanger is attached, said support member having a curved lower margin, a length less than said length of said hanger and having an opening therethrough, said opening having a bottom, said opening being of substantially the same cross-sectional geometry as that of said hanger for mating, such mating preventing said hanger from turning about said support member, said extension member being mounted to said support member through such opening in their combination to each other.

* * * * *